US005408908A

United States Patent [19]

Rosenthal et al.

[11] Patent Number: 5,408,908

[45] Date of Patent: Apr. 25, 1995

[54] CUTTING MACHINE

[76] Inventors: Ben J. Rosenthal, 209 Woodley Rd., Winnetka, Ill. 60093; Gregory Starr, 130 Pauline, Buffalo Grove, Ill. 60089; Arkady Kats, 466 Carman, Buffalo Grove, Ill. 60062; Vadim Birman, 2150 Valencia, Apt. 309, Northbrook, Ill. 60065

[21] Appl. No.: 121,279

[22] Filed: Sep. 14, 1993

[51] Int. Cl.[6] ..... B26D 1/30

[52] U.S. Cl. ..... 83/584; 83/609; 83/611; 83/694; 83/582

[58] Field of Search ..... 83/582, 584, 585, 611, 83/609, 636, 628, 694

[56] References Cited

U.S. PATENT DOCUMENTS

| | | | |
|---|---|---|---|
| 2,580,408 | 1/1952 | Clauss | 83/584 |
| 3,376,775 | 4/1968 | Eliason | 83/582 |
| 3,474,676 | 10/1969 | Morse et al. | 83/585 |
| 3,898,902 | 8/1975 | Cailloux | 83/611 |
| 4,936,177 | 6/1990 | Ozawa et al. | 83/582 |
| 5,044,243 | 9/1991 | Aizawa | 83/584 |
| 5,090,285 | 2/1992 | Kondo | 83/582 |

FOREIGN PATENT DOCUMENTS

| | | | |
|---|---|---|---|
| 0754004 | 8/1956 | United Kingdom | 83/584 |

*Primary Examiner*—Eugenia Jones
*Assistant Examiner*—Allan M. Schrock
*Attorney, Agent, or Firm*—Allegretti & Witcoff, Ltd.

[57] ABSTRACT

A cutting machine for sheet material comprising a frame, a stationary knife on the frame and a reciprocating blade cooperating with the stationary knife. A motor on the frame is connected to a gear reducer that is in turn connected to a single push rod through a crank. The push rod is operatively connected to a torque tube that is connected adjacent its ends by link means to the reciprocating blade. Rotation of the crank by the gear reducer will actuate the single push rod and the torque tube operatively connected thereto to reciprocate the reciprocating blade. Spring means for assisting movement of the reciprocating blade are readily adjusted from exterior of the frame of the cutting machine. A rotatable cam follower on the reciprocating blade engages a guide block on the frame for moving the reciprocating blade into proper cooperative engagement with the stationary knife in use.

5 Claims, 3 Drawing Sheets

CUTTING MACHINE

BACKGROUND OF THE INVENTION

This invention pertains to a cutting machine for sheet material and more particularly to a cutting machine having fewer parts and less complexity then prior cutting machines for sheet material.

There is known in the prior art a cutting machine for sheet material that includes a frame, a stationary knife or blade on the frame and a reciprocating blade on the frame cooperating with the stationary blade for cutting roll material passing between the stationary knife and the reciprocating blade. The reciprocating blade is secured at each end to rocker arms that are each pivotally secured at one end to the reciprocating blade. The rocker arms are each secured to bearing clamps containing bearings. The bearings are journalled on eccentrics carried on a rotatable knife shaft. The knife shaft is rotated by a motor secured to a gear reducer through a clutch brake. The gear reducer is keyed to the knife shaft through a pair of bushings flanking a pair of coupling halves on opposite sides of a spider. Such cutting machine was relatively complex and costly. Further, the up and down movement of the reciprocating blade was guided by the blade bearing against a hardened plate. This arrangement was not very durable. Adjustment of the spring associated with the reciprocating blade was relatively difficult because the adjustment mechanism was not readily accessible from the exterior of the cutting machine.

An object of the present invention is to provide a simplified cutting machine for sheet material wherein parts of the prior cutting machine are eliminated and costs of fabrication and assembly are reduced.

Another object of the present invention is to provide the reciprocating blade with a cam follower to facilitate moving and guiding of the reciprocating blade on the frame means.

Yet another object of the present invention is to provide a cutting machine with a simplified adjustment for the reciprocating blade spring that is easily adjustable from the exterior of the cutting machine. Other objects and advantages of the present invention will be made more apparent hereinafter.

BRIEF DESCRIPTION OF THE DRAWING

There is shown in the attached drawing a presently preferred embodiment of the present invention wherein like numerals in the various views refer to like elements and wherein.

DETAILED DESCRIPTION OF THE PRESENT INVENTION

Figure 1:
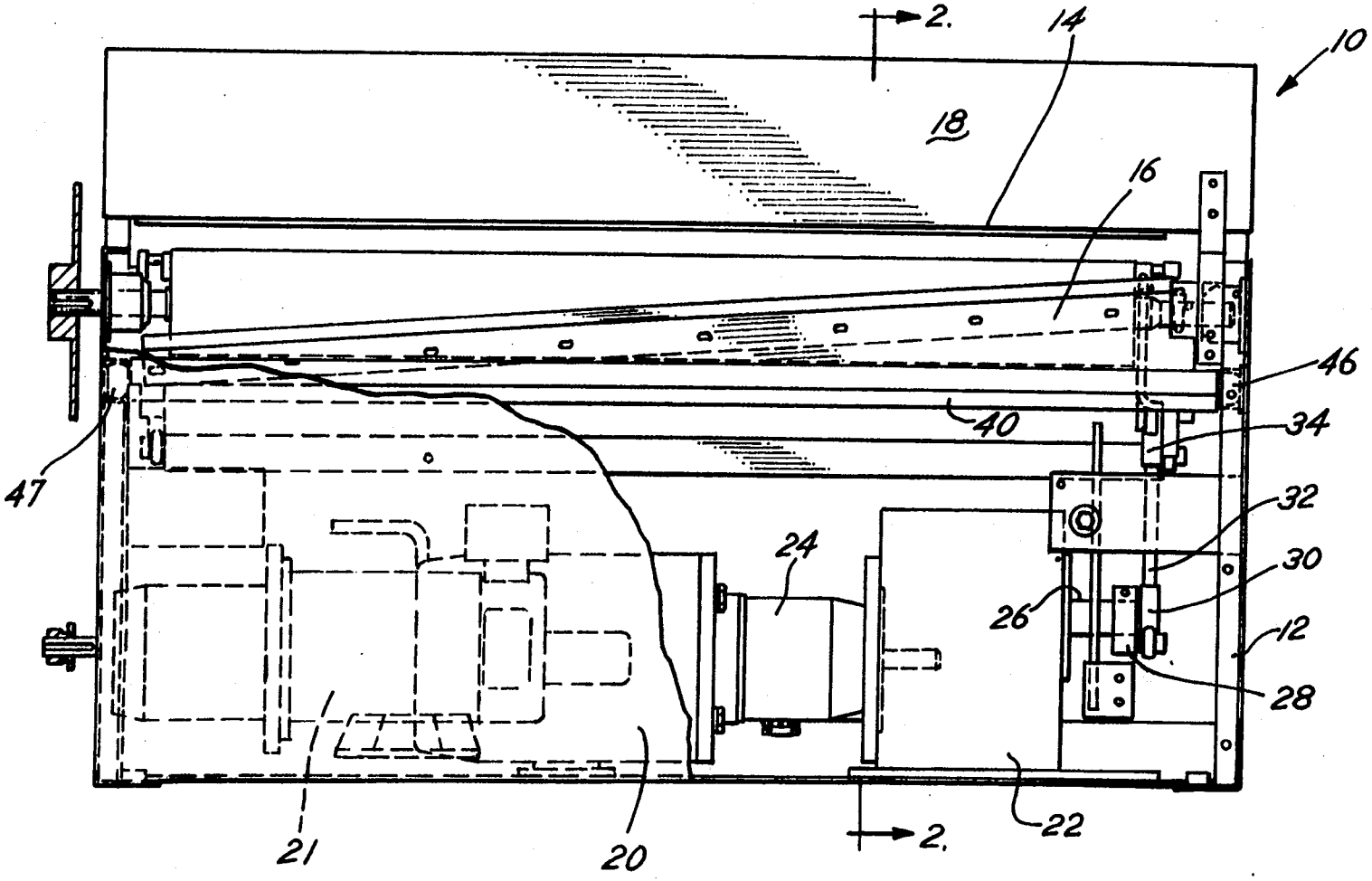
FIG. 1 is a front view of the cutting machine of the present invention.

There is shown in FIG. 1 a front view of the cutting machine 10 of the present invention. The cutting machine 10 includes a frame 12 supporting the components of the cutting machine. Carried on the frame 12 is a stationary blade or knife 14 and a reciprocating blade or knife 16 which cooperates with the stationary blade 14 to cut paper or like material passing therebetween into sheets. The stationary blade 14 is a affixed to a knife channel 18 that is secured to the frame 12.

The reciprocating blade 16 is adapted to be moved up and down by actuation of an electric motor 20 that is connected to a gear reducer 22 by means of a brake clutch 24. The output shaft 26 of the gear reducer is connected to a crank 28 that is joined by a pivot pin to a push rod bearing 30 affixed to the push rod 32 that is in turn joined at its upper end to a second push rod 34. The upper push rod bearing 34 is secured pivotally to a link arm 36 which is pivoted at one end to the reciprocating blade 16 and which is affixed rigidly at its opposite end to a torque bar 40. The torque bar 40 extends transversely of the cutting machine frame 12 and is secured at the opposite end from the link arm 34 to a link arm 42. The link arm 42 is rigidly secured to the torque arm 40 at one end and is pivotally secured at its opposite end to the reciprocating blade 16 in the same fashion as the link arm 34. The torque tube or torque bar 40 is connected at its ends to bearing triangles 46 and 47. The bearing triangles 46 and 47 are affixed by suitable fastening means, for examples screws, to the frame 12. The ends of the torque tube or torque bar 40 are pivotally secured to the bearing triangles 46 and 47. It will be readily understood that the single push rod 32 may be actuated by the motor drive means comprising the motor 20, the gear reducer 22 and the brake clutch 24 to actuate the single push rod up and down. The single push rod being connected to the link 34 will cause the link to pivot through the access of the torque tube and lower one side of the reciprocating blade. The torque will be transmitted through the torque tube 40 to the opposite link arm 42 and thus by actuation of a single push rod 32, the link arms 34 and 42 will be simultaneously actuated in order to raise and lower the reciprocating blade 16. An advantage of this construction as compared to a prior like machine is that only a single push rod is necessary and the various bearings and other linkage associated with the prior machine have been eliminated.

Figure 2:
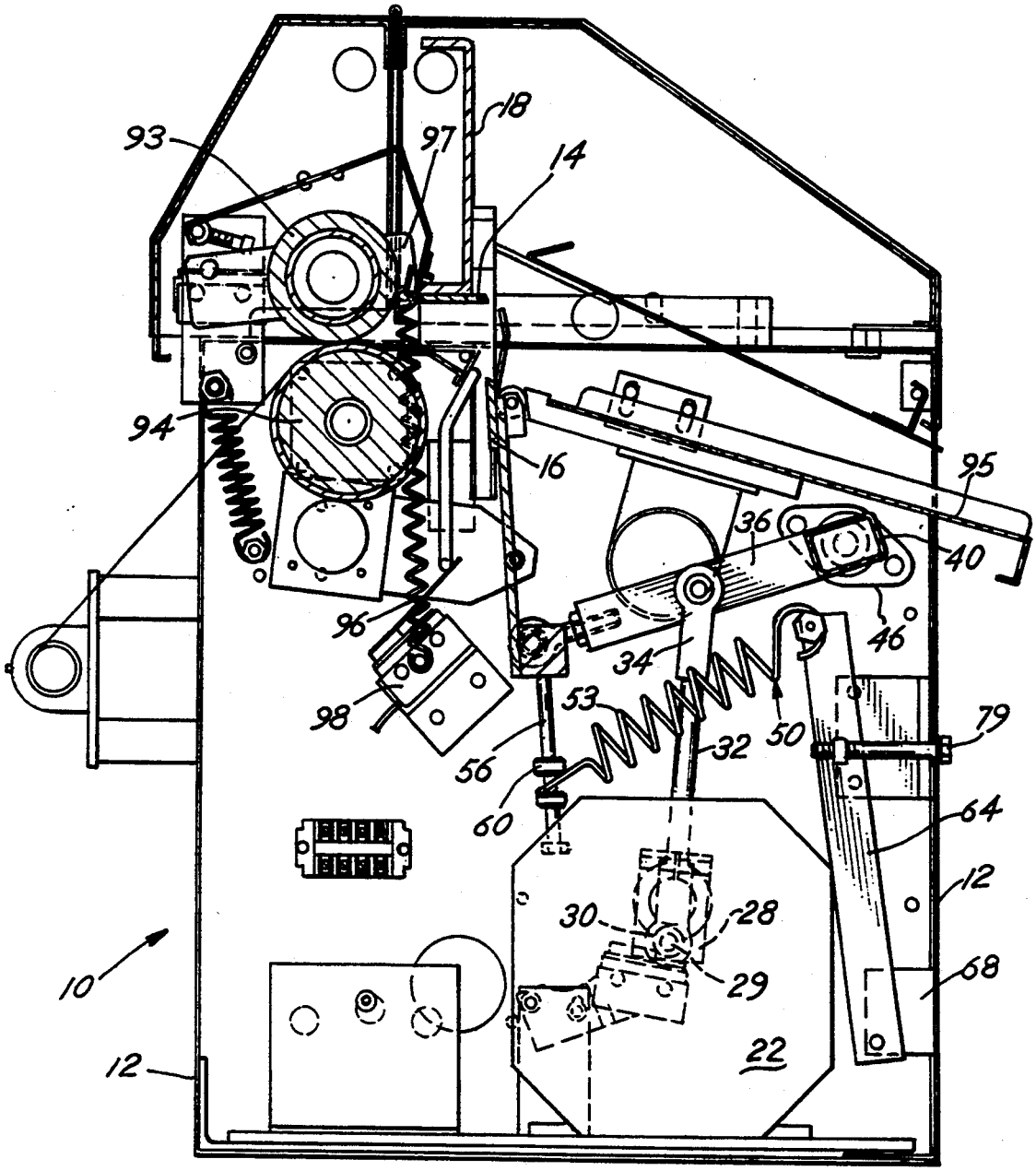
FIG. 2 is a cross section taken generally along the line 2—2 of FIG. 1.
Figure 3:
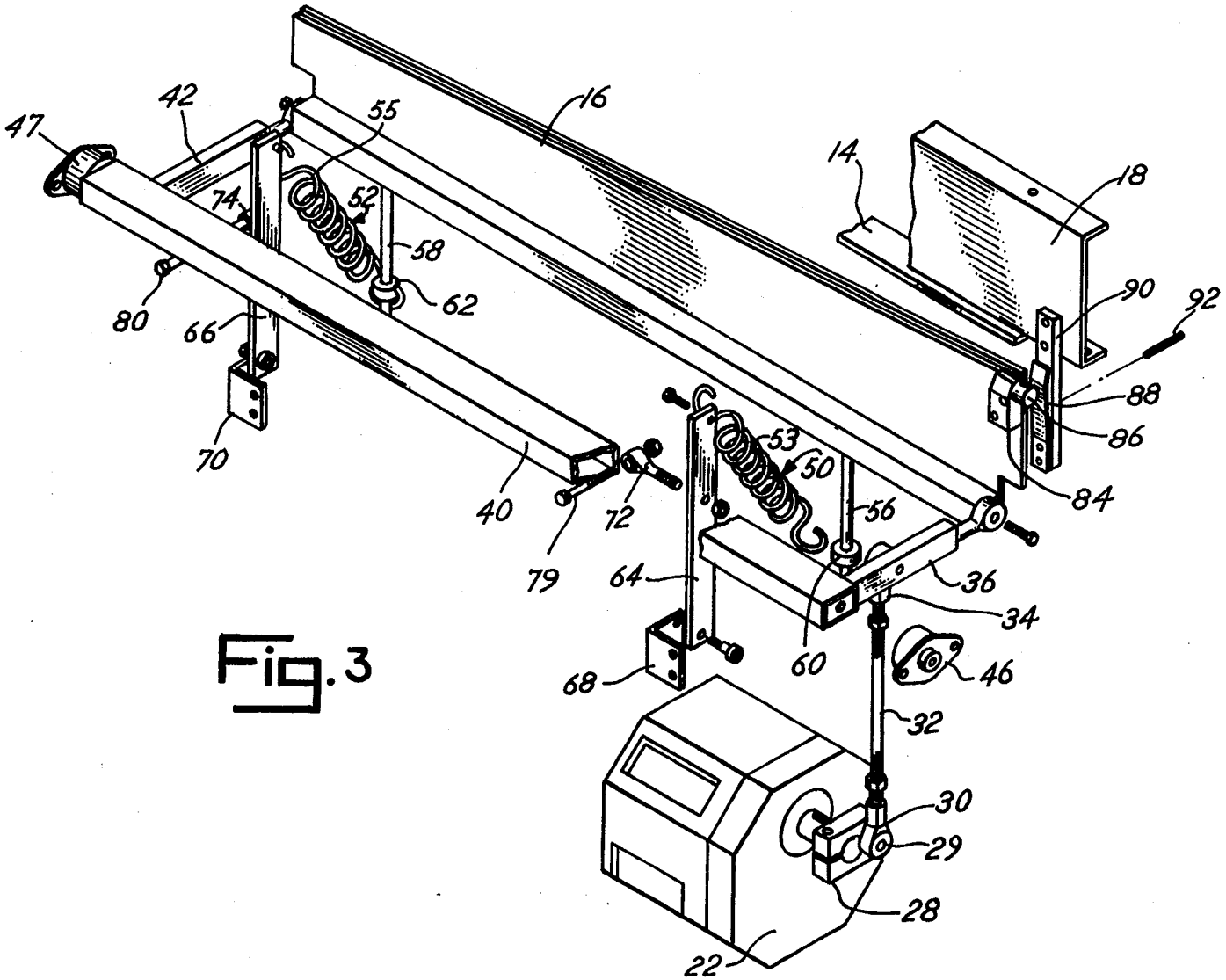
FIG. 3 is an exploded perspective view better illustrating the drive arrangement for the reciprocating blade and the relationship of the parts.

The reciprocating blade 16 is provided with a tension spring for facilitating the motion of the same, the spring means 50 and 52 are each readily adjusted from the exterior of the frame 12. As best seen in FIGS. 2 and 3, the spring means comprise a tension spring connected to a shaft 56, 58 that depends from the reciprocating blade 16. One end of the shaft is affixed to a collar 60 and 62 respectively on the shafts 56 and 58 respectively. The opposite ends of the springs 50, 52 are secured to a tension control arm 64, 66 respectively. Each tension control arm is pivoted at its lower end to a bracket 68, 70 that is secured to the frame 12. Intermediate the ends of the bracket that pivots the tension control arm and the end of the tension control arm secured to the spring 50 there is provided an opening for receiving an I-bolt 72, 74. The I-bolt extends transversely of the tension control rods 64, 66 and adjustment bolt 79, 80 is secured to the I-bolt 72, 74 for adjusting the position of the tension control arm and therefore the tension on the associated spring. The adjustment bolts 79 and 80 extend through the front of the frame 12 as best seen in FIG. 2 and upon rotation of the adjustment bolts with respect to the I-bolt 72, 74 the tension control arm 64, 66 can be suitably pivoted to adjust the tension of the springs 50 and 52. This adjustment is effectively accomplished from the exterior of frame 12 and is readily done by the machine operator.

It should be noted that the reciprocating blade 16 has affixed at one end thereof a cam follower block 84 that carries a rotatable cam follower 86. The rotatable cam follower 86 is adapted to abut a guide block spring 88 that is carried on a guide block 90 that is affixed rigidly to the knife channel 18. The screw 92 engages with the block 90 for the purpose of adjusting the position of the spring 88. The cam follower 86 will help to guide the reciprocating knife 16 into proper engagement by rolling on the spring 88 adjoined to the block 90.

The rollers 93 and 94 journalled on the frame cooperate with one another so as to move the paper or like material through the cutting machine 10. The rolls 93 and 94 may be controlled by a suitable machine control to provide a predetermined length of feed such that the paper or like material to be cut passes through between the knife 14 and the knife 16. The control may then be used to actuate the motor 20 to cause the power to be applied to the single push rod 32 to reciprocate the blade 16 relative to the stationary blade 14 so as to cut off a predetermined length of material. The material will pass on to the tray 95 and can be withdrawn sheet by sheet or with a predetermined number of sheets by the operator of the machine.

With reference to FIG. 2, spring 96 acts between bracket 98 fixed on the frame and bracket 97 pivoted on the frame and carrying the roller 93 to bias the roller 93 toward the roller 94.

The cutting machine may be provided with safety switch means for terminating operation of the cutting machine in the event of jamming or following of feeding of the material into the cutting machine. Though the control means are not shown as they form no part of this invention, it will be understood that the cutting machine 10 may be operated manually by a button on the control means, by a foot pedal, or automatically. The control means may include an encoder assembly by which the length of sheet material to be cut can be pre-set and by which the number of lengths to be cut can; also be pre-set.

While we have shown a presently preferred embodiment of the present invention, it will be understood that the invention may be otherwise embodied within the scope of the following claims.

I claim:

1. A cutting machine for sheet material, comprising a frame, knife means on said frame including a stationary knife and a reciprocating blade cooperating therewith, motor means on said frame having an output shaft, a crank on said output shaft, a single push rod connected to and operatively activated by said crank, a torque tube mounted on the frame, said push rod operatively connected to said torque tube for actuating the torque tube, said torque tube being operatively connected to the reciprocating blade by link means for actuating the reciprocating blade in response to rotation of said output shaft, and spring means connected between the frame and the reciprocating blade for facilitating motion of the reciprocating blade, said spring means comprising at lease one tension spring and means for adjusting the tension of said tension spring said adjusting means including at lease one tension control arm pivotally connected to the frame adjacent one end of the arm, and an adjustable bolt affixed between the frame and the tension control arm for adjusting the position of the tension control arm, and the tension of the spring affixed thereto, said adjustment bolt being readily accessible from an exterior portion of the cutting machine.

2. A cutting machine as in claim 1 including a rotatable cam follower on the reciprocating blade cooperating with guide block means on the frame for guiding the movement of the reciprocating blade into cooperative engagement with the stationary blade.

3. A cutting machine as in claim 2, wherein the guide block means comprises a guide block affixed to the frame, and a guide block spring on the guide block that engages with the rotatable cam follower.

4. A cutting machine as in claim 3, wherein the guide block means includes an adjustment screw carried by the guide block and engaging the guide block spring for adjusting the position of the guide block spring with respect to the rotatable cam follower.

5. A cutting machine as in claim 1 wherein said spring means comprises a first tension spring and a second tension spring, and said adjusting means comprises a first tension control arm and a second tension control arm, the first tension spring connected at one end to the first tension control arm and operatively connected at the other end to the reciprocating blade, the second tension spring connected at one end to the second tension control arm and operatively connected at the other end to the reciprocating blade.

* * * * *